US007554565B2

(12) United States Patent
Baek

(10) Patent No.: US 7,554,565 B2
(45) Date of Patent: Jun. 30, 2009

(54) DISPLAY DEVICE CAPABLE OF ADJUSTING BRIGHTNESS LEVEL AND DRIVING METHOD THEREOF

(75) Inventor: Heum-Il Baek, Seoul (KR)

(73) Assignee: LG Display Co., Ltd., Seoul (KR)

( * ) Notice: Subject to any disclaimer, the term of this patent is extended or adjusted under 35 U.S.C. 154(b) by 701 days.

(21) Appl. No.: 10/876,627

(22) Filed: Jun. 28, 2004

(65) Prior Publication Data

US 2005/0151711 A1 Jul. 14, 2005

(30) Foreign Application Priority Data

Dec. 30, 2003 (KR) ..... 10-2003-0099917

(51) Int. Cl.
*G09G 5/10* (2006.01)

(52) U.S. Cl. ..... 345/690; 345/88

(58) Field of Classification Search ..... 345/88, 345/89, 98, 690, 691
See application file for complete search history.

(56) References Cited

U.S. PATENT DOCUMENTS 6,814,420 B2 * 11/2004 Fujita et al. ..... 347/15
7,277,075 B1 * 10/2007 Hirano et al. ..... 345/89
2003/0090693 A1 * 5/2003 Tezuka et al. ..... 358/1.9
2003/0193515 A1 * 10/2003 Hill et al. ..... 345/695
2004/0036704 A1 * 2/2004 Han et al. ..... 345/690

FOREIGN PATENT DOCUMENTS

JP 11321901 A 11/1999
WO WO0137249 * 6/2002

* cited by examiner

*Primary Examiner*—Chanh Nguyen
*Assistant Examiner*—Calvin C Ma
(74) *Attorney, Agent, or Firm*—McKenna Long & Aldridge LLP

(57) ABSTRACT

A display device includes an image attribute signal generating portion analyzing R, G, and B input data signals with first brightness levels and generating attribute signals; a signal treating portion converting the R, G, and B input data signals to R, G, and B output data signals using the plurality of attribute signals, wherein R, G, and B input data signals used to display images having colors other than white are converted to R, G, and B output data signals, wherein the R. G, and B output data signals have second brightness levels, wherein the second brightness levels are lower than the first brightness levels; and a display portion having a plurality of pixels, wherein each pixel includes R, G, and B sub-pixels, and wherein the R, G, and B output data signals are supplied to respective ones of the R, G, and B sub-pixels.

13 Claims, 7 Drawing Sheets

DISPLAY DEVICE CAPABLE OF ADJUSTING BRIGHTNESS LEVEL AND DRIVING METHOD THEREOF

This application claims the benefit of Korean Patent Application No. 2003-99917, filed on Dec. 30, 2003, which is hereby incorporated by reference for all purposes as if fully set forth herein.

BACKGROUND OF THE INVENTION

1. Field of the Invention

The present invention relates to display devices. More particularly, the present invention relates to display devices having pixels comprising red, green, and blue sub-pixels.

2. Discussion of the Related Art

Generally, cathode ray tubes (CRTs) are commonly used as display devices. Flat panel displays, having a lightweight, compact construction, and which consume low amounts of power (e.g., liquid crystal displays (LCDs), plasma display panels (PDPs), field emission displays, and electro-luminescence displays (ELDs)) are also commonly used. Contrary to other types of display devices, LCDs are non-luminous display devices in that they cannot display images without some light source (e.g., ambient light or a backlight).

FIG. 1 illustrates a related art LCD device.

Referring to FIG. 1, the related art LCD device 100 generally includes a timing controlling portion 130, a gray-level generation portion 120, a gate driving portion 140, a data driving portion 150, and a display portion 160.

The timing controlling portion 130 supplies R (red), G (green), and B (blue) data signals to the data driving portion 150, and a plurality of control signals to gate and data driving portions 140 and 150, respectively, enabling the LCD device 100 to display images.

The gray-level generating portion 120 generates "i"-number of gray-level voltages "$V_1$~$V_i$" corresponding to "i"-number of gray-levels. Thus, where the supplied R, G, and B data signals each have 8 bits, the gray-level generating portion 120 generates $2^8$ gray-level voltages "$V_1$~$V_{256}$".

The gate driving portion 140 outputs gate signals to gate lines 145 and the data driving portion 150 outputs data signals to data lines 155.

The display portion 160 includes a plurality of pixels arranged in a matrix pattern. Each pixel includes R, G, and B sub-pixels that display red, green, and blue colors, respectively. Each sub-pixel includes a thin film transistor "T", a liquid crystal capacitor "$C_{LC}$", and a storage capacitor "$C_{ST}$".

A gate electrode of each thin film transistor "T" is connected to a corresponding gate line 145, a source electrode of each thin film transistor "T" is connected to a corresponding data line 155, and a drain electrode of each thin film transistor "T" is connected to a first electrode of a corresponding liquid crystal capacitor "$C_{LC}$". A second electrode of each liquid crystal capacitor "$C_{LC}$" is connected to a common electrode. A first electrode of each storage capacitor "$C_{ST}$" is connected to a drain electrode of a corresponding thin film transistor "T" and a second electrode of each storage capacitor "$C_{ST}$" is connected to a previous one of the gate lines 145.

To drive the above-described related art LCD device 100, one of a plurality of gate lines 145 is selected during a frame and a gate-ON signal is supplied to each thin film transistor "T" via the selected gate line 145. Supplied with the gate-ON signal, each thin film transistor "T" is provided in an ON-state and a channel of each thin film transistor "T" is provided in an open state.

While the channel of each thin film transistor "T" is provided in the open state, the data driving portion 150 supplies R, G, and B data signals to respective ones of the R, G, and B sub-pixels connected to the selected gate line 145. Accordingly, R, G, and B data signals supplied to R, G, and B sub-pixels are charged within the liquid crystal capacitor "$C_{LC}$" and the storage capacitor "$C_{ST}$" of each sub-pixel.

Next, an immediately succeeding gate line 145 is selected, and the thin film transistors "T" connected with the previously selected gate line 145 is provided in an OFF-state. However, the R, G, and B data signals, charged within the liquid crystal capacitor "$C_{LC}$" and the storage capacitor "$C_{ST}$" of the sub-pixels connected to the previously selected gate line 145 remain charged therein until a next frame. By repeating the operation described above, the display portion 160 displays images.

FIG. 2 illustrates a gamma curve of a related art liquid crystal display device having a gamma value "γ" of 2.2.

Referring to FIG. 2, the gamma curves of white, red, green, and blue colors are equal. Therefore, the related art liquid crystal display device expresses a white color at the same brightness level as it would express red, green, and blue colors when a data signal corresponding to the white color has a same gray-level of data signals corresponding to the red, green, and blue colors. As a result, the display region 160 displays pictures at a reduced contrast ratio, making it difficult to display distinct images.

FIG. 3 illustrates a picture displayed by a related art liquid crystal display device.

Referring to FIG. 3, a difference in brightness levels to which white, red, green, and blue colors is minimal. As a result, the images of the helicopter and surrounding bushes are not distinct.

SUMMARY OF THE INVENTION

Accordingly, the present invention is directed to a display device and a driving method thereof that substantially obviates one or more of the problems due to limitations and disadvantages of the related art.

An advantage of the present invention provides a display device and a driving method thereof that prevents contrast ratio reduction and displays images distinctly.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device may, for example, include an image attribute signal generating portion that analyzes R, G, and B input data signals and generates a plurality of attribute signals, wherein the R, G, and B input data signals have first brightness levels; a signal treating portion that converts the R, G, and B input data signals to R, G, and B output data signals using the plurality of attribute signals, wherein R, G, and B input data signals used to display images having colors other than white are converted to R, G, and B output data signals, wherein the R, G, and B output data signals have second brightness levels, wherein the second brightness levels are lower than the first brightness levels; and a display portion having a plurality of pixels, wherein each pixel includes R, G, and B sub-pixels, and wherein the R, G, and B output data signals are supplied to respective ones of the R, G, and B sub-pixels.

In another aspect of the present invention, a method of driving a display device may, for example, include analyzing R, G, and B input data signals and generating a plurality of attribute signals, wherein the R, G, and B input data signals have first brightness levels; converting the R, G, and B input data signals to R, G, and B output data signals using the plurality of attribute signals, wherein predetermined ones of the R, G, and B input data signals used to display color images other than white color images are converted to R, G, and B output data signals, wherein the R, G, and B output data signals have second brightness levels, wherein the second brightness levels are lower than the first brightness levels; and displaying images via a plurality of pixels, wherein each pixel includes R, G, and B sub-pixels, and wherein the R, G, and B output data signals are supplied to respective ones of the R, G, and B sub-pixels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 4A:
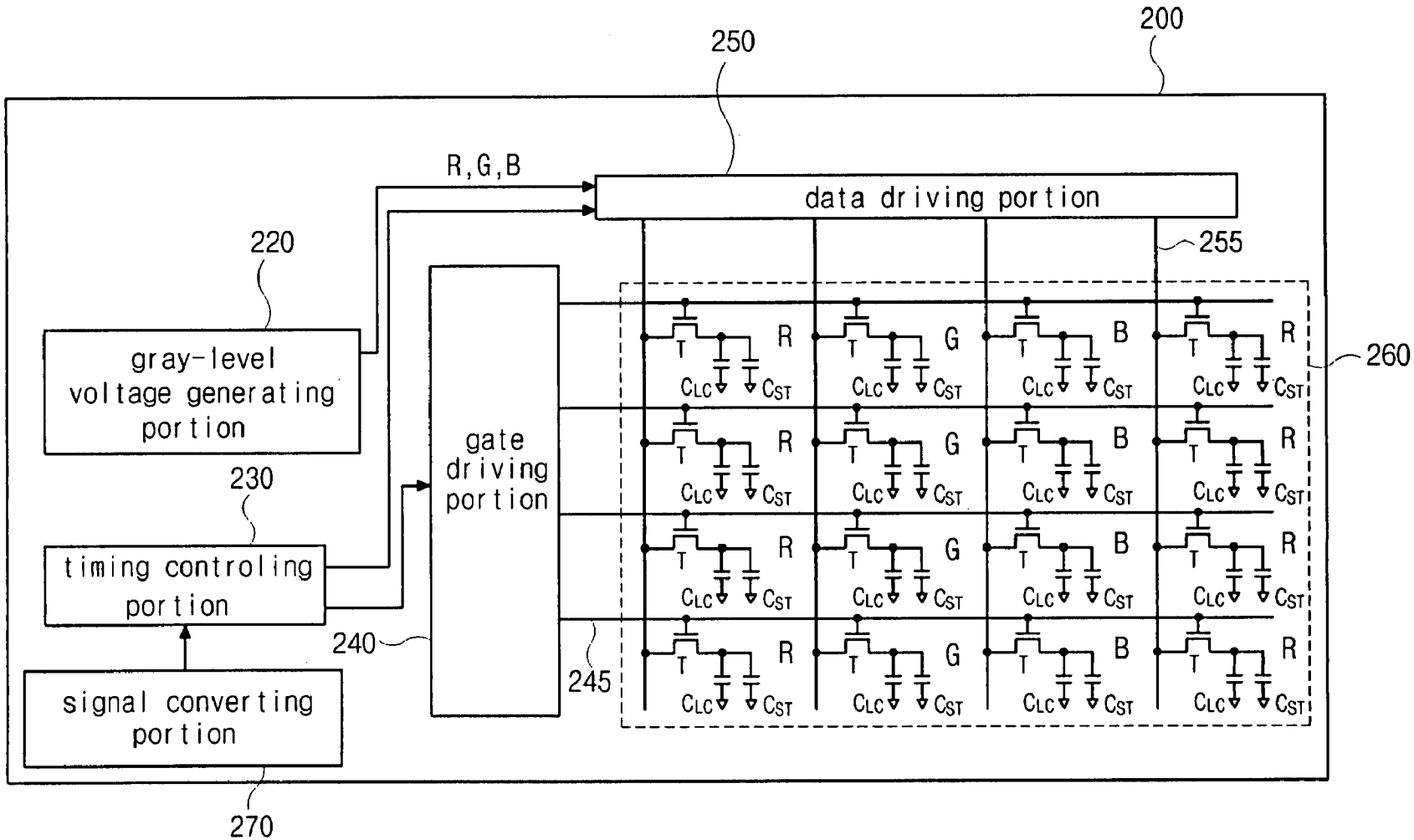
FIG. 4A illustrates a liquid crystal display device according to the present invention.
Figure 4B:
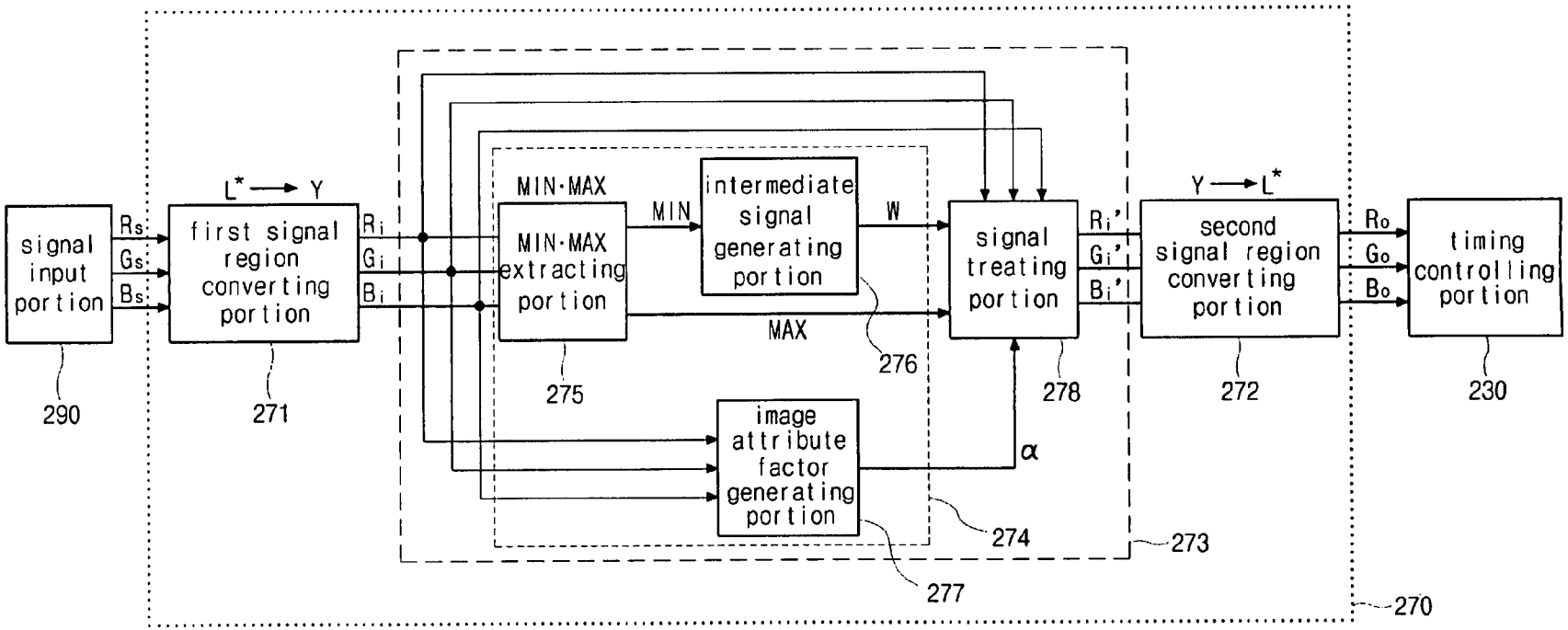
FIG. 4B illustrates a signal converting portion shown in FIG. 4A.

FIG. 4A illustrates a liquid crystal display device according to the present invention. FIG. 4B illustrates a signal converting portion shown in FIG. 4A.

Referring to FIG. 4A, a liquid crystal display (LCD) device 200 of the present invention may, for example, include a timing controlling portion 230, a gray-level generation portion 220, a gate driving portion 240, a data driving portion 250, a display portion 260, and a signal converting portion 270.

In one aspect of the present invention, the timing controlling portion 230 may, for example, supply R (red), G (green), and B (blue) data signals to the data driving portion 250 in accordance with a timing sequence and a plurality of control signals to gate and data driving portions 240 and 250, respectively, enabling the LCD device 200 to display images.

In one aspect of the present invention, the gray-level generating portion 220 may, for example, generate "i"-number of gray-level voltages "$V_1$~$V_i$" corresponding to "i"-number of gray-levels. Thus, where the supplied R, G, and B data signals have 8 bits, the gray-level generating portion 220 may generate $2^8$ gray-level voltages "$V_1$~$V_{256}$".

In one aspect of the present invention, the gate driving portion 240 may, for example, output gate signals to gate lines 245 and the data driving portion 250 may, for example, output data signals to data lines 255.

In one aspect of the present invention, the display portion 260 may, for example, include a plurality of pixels arranged in a matrix pattern. Each pixel may, for example, include R, G, and B sub-pixels that display red, green, and blue colors, respectively. Each sub-pixel may, for example, include a thin film transistor "T", a liquid crystal capacitor "$C_{LC}$", and a storage capacitor "$C_{ST}$". The display portion 260 is supplied light to by a light source (not shown).

In one aspect of the present invention, a gate electrode of each thin film transistor "T" may be connected to a corresponding gate line 245, a source electrode of each thin film transistor "T" may be connected to a corresponding data line 255, and a drain electrode of each thin film transistor "T" may be connected to a first electrode of a corresponding liquid crystal capacitor "$C_{LC}$". A second electrode of each liquid crystal capacitor "$C_{LC}$" may be connected to a common electrode. A first electrode of each storage capacitor "$C_{ST}$" may be connected to a drain electrode of a corresponding thin film transistor "T" and a second electrode of each storage capacitor "$C_{ST}$" may be connected to a previous one of the gate lines 245.

In one aspect of the present invention, the signal converting portion 270 may, for example, convert R, G, and B data signals and subsequently supply the converted R, G, and B data signals to the timing controlling portion 230.

For example, the signal converting portion 270 may include first and second signal region converting portions 271 and 272, respectively, connected to each other through a signal adjusting portion 273.

In one aspect of the present invention, the first signal region converting portion 271 may convert a signal region of a data signal provided by a signal input portion 290. For example, the signal input portion 290 may output source data signals "Rs", "Gs", and "Bs" in an L* signal region, wherein the L* signal region represents a brightness value of light as determined by the human eye. Accordingly, the first signal region converting portion 271 may convert the source data signals "Rs", "Gs", and "Bs" in the L* signal region to input data signals "Ri", "Gi", and "Bi" in a Y signal region, wherein the Y signal region represents a luminance value of light as determined by an instrument. In one aspect of the present invention, the first signal region converting portion 271 may convert the source data signals in the L* signal region to the input data signal in the Y signal region according to a first signal region converting expression, a reverse function of $L^*=116(Y/Yn)^{1/3}-16$ (L* is a representative of "Rs", "Gs", and "Bs", Y is a representative of "Ri", "Gi", and "Bi", and Yn is luminance value of a light source).

In one aspect of the present invention, the first signal region converting portion 271 may, for example, include a look-up table (LUT) where input data signal values are pre-calculated from source data signal values in accordance with the first signal region converting expression. Accordingly, source data signals "Rs", "Gs", and "Bs" may be converted to input data signals "Ri", "Gi", and "Bi" via the look-up table (LUT) of the first signal region converting portion 271.

In one aspect of the present invention, the signal adjusting portion 273 may, for example, include an image attribute signal generating portion 274 and a signal treating portion 278.

The image attribute signal generating portion 274 may, for example, include a MIN-MAX extracting portion 275, an intermediate signal generating portion 276, and an image attribute factor generating portion 277.

In one aspect of the present invention, the MIN-MAX extracting portion 275 may extract minimum and maximum values "MIN" and "MAX", respectively, of the input data signals "Ri", "Gi", and "Bi" in accordance with respective expressions: MIN=Min(Ri, Gi, Bi); and MAX=Max(Ri, Gi, Bi). The MIN-MAX extracting portion 275 may then supply the extracted maximum signal "MAX" to the signal treating portion 278 and supply the extracted minimum signal "MIN" to the intermediate signal generating portion 276.

In one aspect of the present invention, the intermediate signal generating portion 276 may generate an intermediate signal "W" (i.e., a virtual white data signal) in accordance with the expression: $W=MIN^k$ (k is a real number).

In one aspect of the present invention, the image attribute factor generating portion 277 may analyze attributes of input data signals "Ri", "Gi", and "Bi" (e.g., contrast ratio and distinctness of images displayed) and generate an image attribute factor "α" wherein $0 \leqq \alpha \leqq 1$. According to principles of the present invention, the contrast ratio of displayed images may be adjusted in accordance with the image attribute factor "α". Therefore, when the image attribute factor "α" increases, the contrast ratio of displayed images increases and when the image attribute factor "α" decreases, the contrast ratio of displayed images decreases.

In one aspect of the present invention, the signal treating portion 278 may convert input data signals "Ri", "Gi", and "Bi" to treated input data signals "Ri'", "Gi'", and "Bi'" using the maximum signal "MAX", the image attribute factor "α", and the intermediate signal "W" in accordance with the expression: $(Ri', Gi', Bi')=((1-\alpha)\times MAX+\alpha\times W)/MAX\times(Ri, Gi, Bi)$, wherein $0 \leqq ((1-\alpha)\times MAX+\alpha\times W))/MAX \leqq 1$. Therefore, the treated input data signals "Ri'", "Gi'", and "Bi'" may be less than or equal to corresponding ones of the input data signals "Ri", "Gi", and "Bi". For example, when $\alpha=0.5$ and $k=1$, $(Ri', Gi', Bi')=(MAX+W)/(2MAX)\times(Ri, Gi, Bi)=(MAX+MIN)/(2MAX)\times(Ri, Gi, Bi)$.

When input data signals "Ri", "Gi", and "Bi" are "H", "0", and "0", respectively, an image having a red color is displayed, wherein W=MIN=Min(Ri, Gi, Bi)=0, MAX=Max(Ri, Gi, Bi)=H. Therefore $Ri'=(MAX+MIN)/(2MAX)\times Ri=(H+0)/(2H)\times H=H/2$, Gi'=0, and Bi'=0. Accordingly, a brightness level of treated input data signals displaying an image having a red color may be half the brightness level of the input data signals from which the treated input data signals are derived.

However, when all of input data signals "Ri", "Gi", and "Bi" are "H", an image having a white color, W, is displayed. Accordingly, W=MIN=Min(Ri, Gi, Bi)=H, MAX=Max(Ri, Gi, Bi)=H. Therefore, $(Ri', Gi', Bi')=(MAX+MIN)/(2MAX)\times(Ri, Gi, Bi)=(H+H)/(2H)\times H=H$. Accordingly, a brightness level of treated input data signals displaying an image having a white color is as equal to the brightness level of input data signals from which the treated input data signals are derived.

As shown above, when $\alpha=0.5$ and $k=1$, the brightness level of the treated input data signals used to display images having a white color may be twice the brightness level of treated input data signals used to display images having a red color. Principles of the invention outlined above are equally applicable to the display of images having blue and green colors.

In view of the discussion above, brightness levels of treated input data signals corresponding to red, green, and blue colors are lower than brightness levels of the input data signals from which they are derived. Therefore, the brightness level to which the display region 260 displays images having a white color may be larger than the brightness level to which the display region 260 displays images having red, green, and blue colors. Accordingly, the contrast ratio of images displayed by the display region 260 may be increased over the contrast ratio of images displayed by the related art display region 160.

When $\alpha=0.3$ and $k=1$, a brightness level of the treated input data signal "Ri'", displaying an image having a red color, is 0.7H (i.e., Ri'=0.7H), and brightness levels of the treated input data signals "Ri'", "Gi'", and "Bi'", displaying an image having a white color, are H (i.e., (Ri', Gi', Bi')=H).

Once generated, the treated input data signals "Ri'", "Gi'", and "Bi'" may be supplied to the second signal region converting portion 272. The second signal region converting portion 272 may convert a signal region of a data signal provided by the signal treating portion 278. For example, the signal treating portion 278 may output treated input data signals "Ri'", "Gi'", and "Bi'" in the Y signal region and the second signal region converting portion 272 may convert the treated input data signals "Ri'", "Gi'", and "Bi'" to output data signals "Ro", "Go", and "Bo" in the L* signal region. In one aspect of the present invention, the second signal region converting portion 272 may convert the treated input data signals in the Y signal region to the output data signals in the L* signal region according to a second signal region converting expression wherein $L^*=116(Y/Yn)^{1/3}-16$.

In one aspect of the present invention, the second signal region converting portion 272 may, for example, include a look-up table (LUT) where output data signal values are pre-calculated from treated input data signal values in accordance with the second signal region converting expression. Accordingly, treated input data signals "Ri'", "Gi'", and "Bi'" may be converted to output data signals "Ro", "Go", and "Bo" via the look-up table of the second signal region converting portion 272.

In one aspect of the present invention, the output data signals "Ro", "Go", and "Bo" may be supplied to the timing controlling portion 230. In turn, the timing controlling portion 230 may supply the output data signals "Ro", "Go", and "Bo" to the data driving portion 250. The data driving portion 250 may then supply the output data signals "Ro", "Go", and "Bo" to respective ones of the sub-pixels "R", "G", and "B" via data lines 255.

Figure 5:
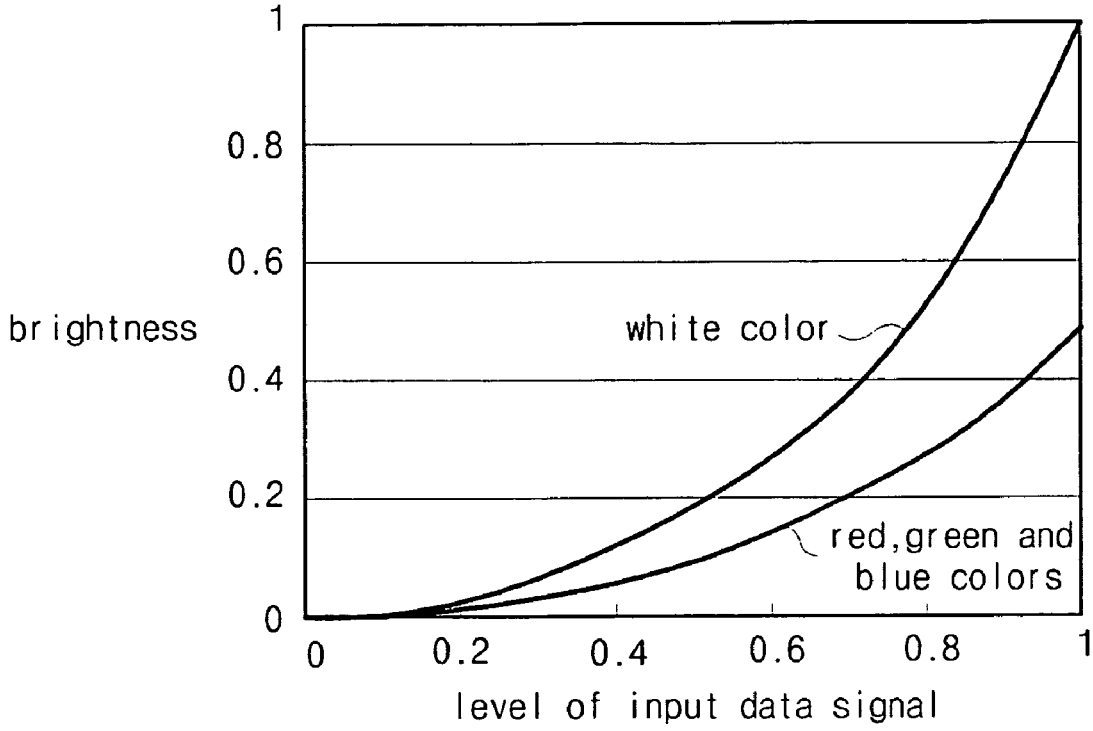
FIG. 5 illustrates a gamma curve of the liquid crystal display device according to the present invention.

FIG. 5 illustrates a gamma curve of the liquid crystal display device according to the present invention having a gamma value "γ" of 2.2.

Referring to FIG. 5, the gamma curve of the white color is different from gamma curves of red, green, and blue colors. Specifically, the gamma curve of the white color is greater than gamma curves of red, green, and blue colors. For example, the liquid crystal display device of the present invention expresses a white color at twice the brightness at which it expresses red, green, blue colors. As a result, the display region 260 displays pictures at an increased contrast ratio, making it easier to display distinct images.

Figure 6:
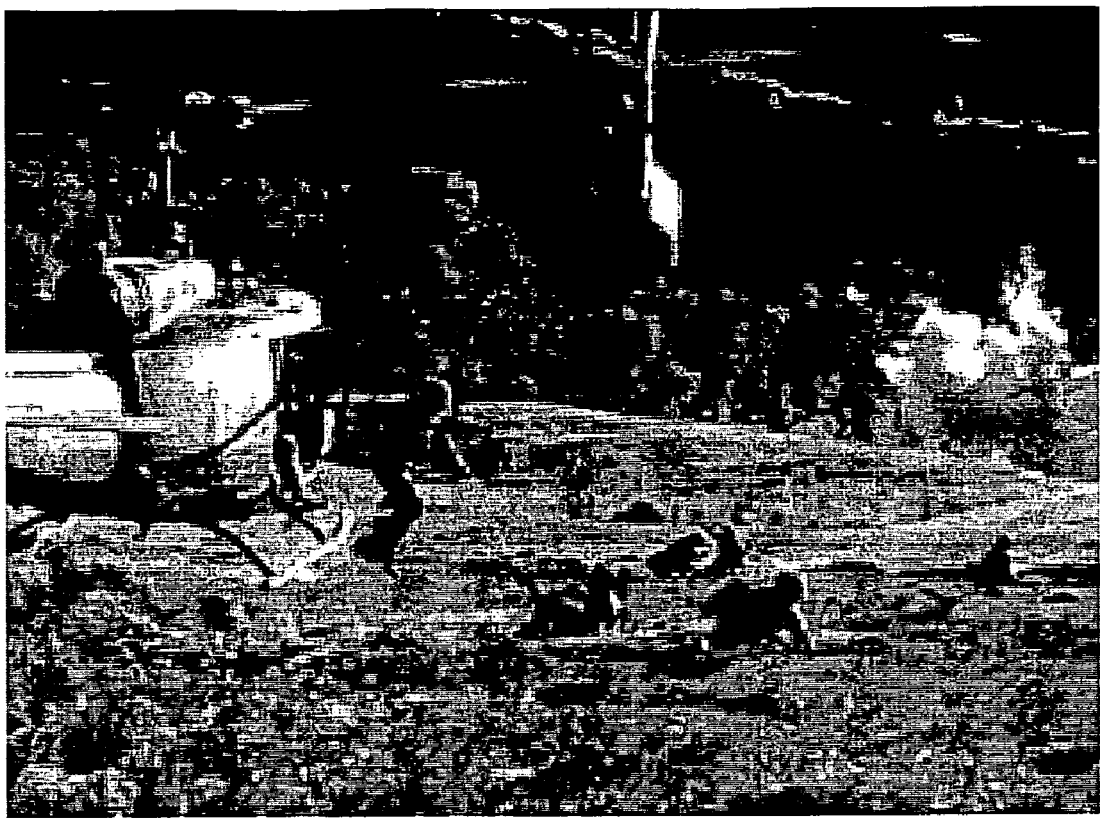
FIG. 6 illustrates a picture displayed by the liquid crystal display device according to the present invention.

FIG. 6 illustrates a picture displayed by a liquid crystal display device according to the present invention.

Figure 1:
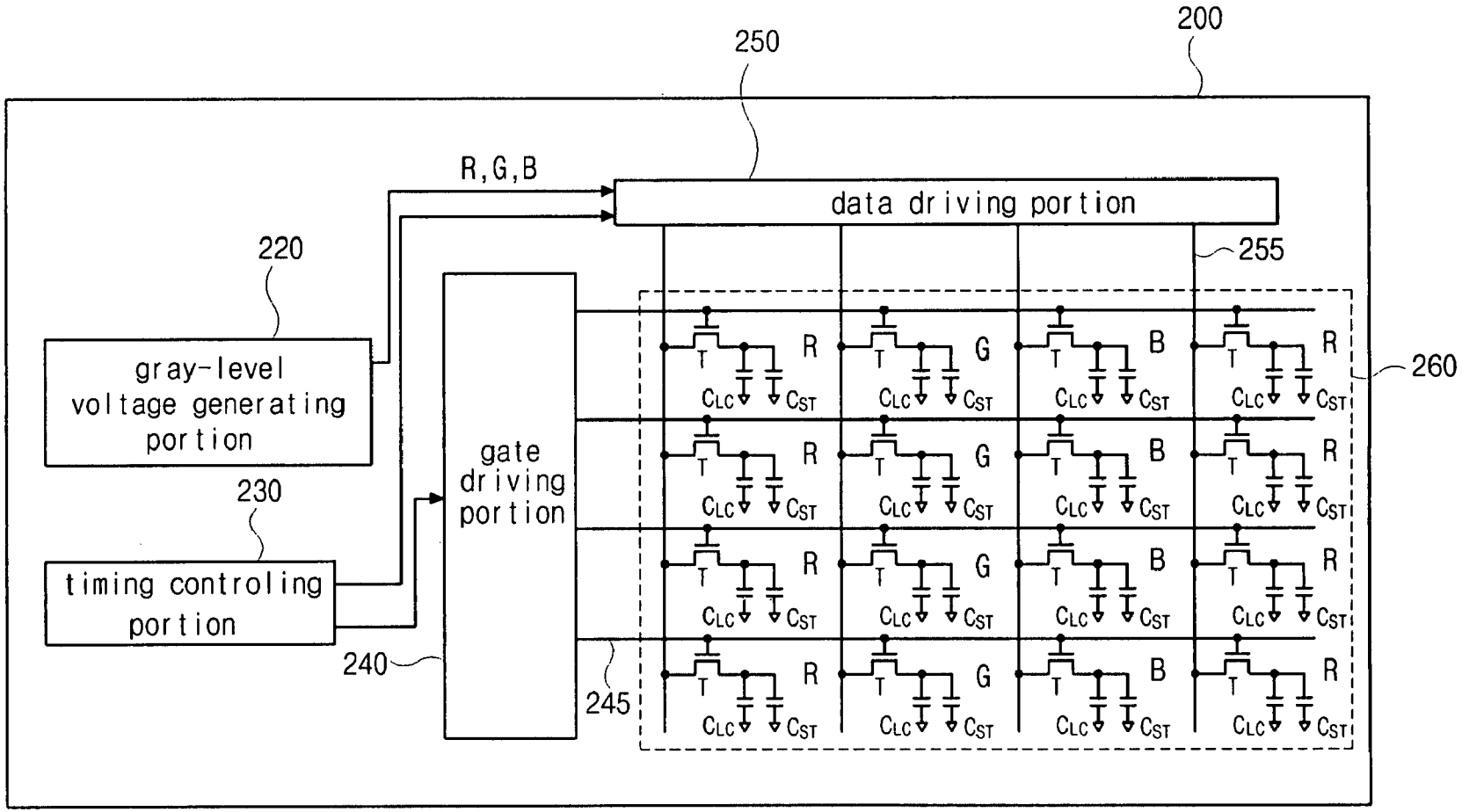
FIG. 1 RELATED ART
FIG. 1 illustrates a related art non-luminous LCD device.
Figure 2:
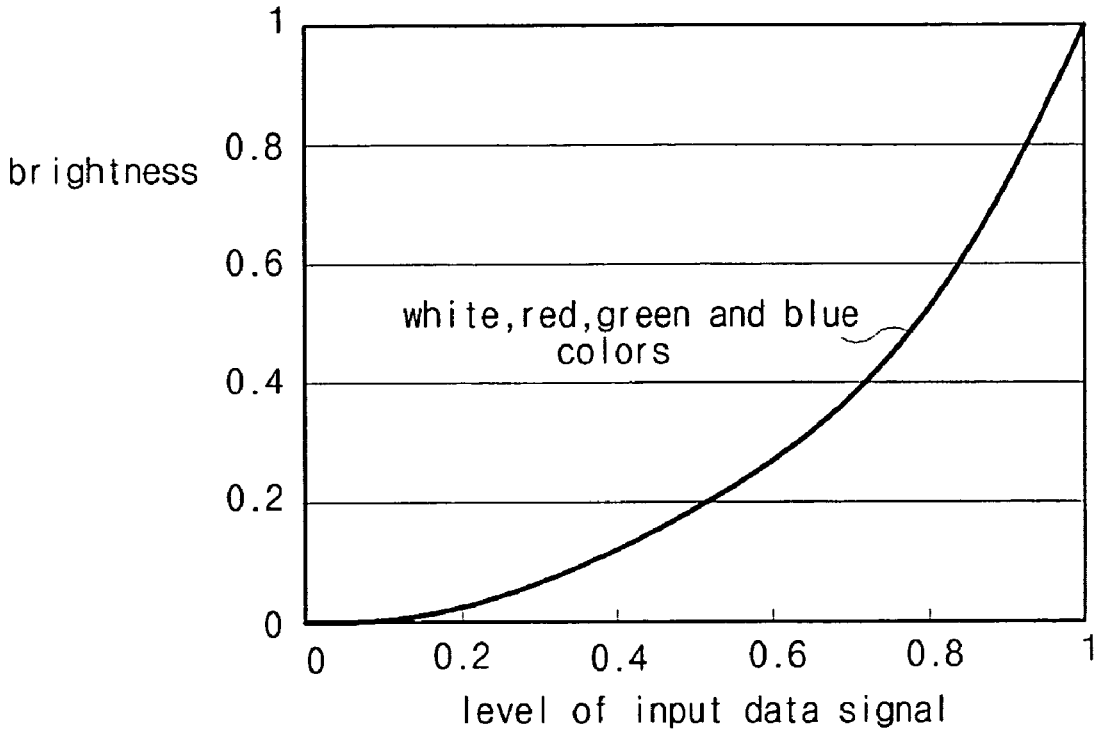
FIG. 2 RELATED ART
FIG. 2 illustrates a gamma curve of a related art liquid crystal display device.
Figure 3:
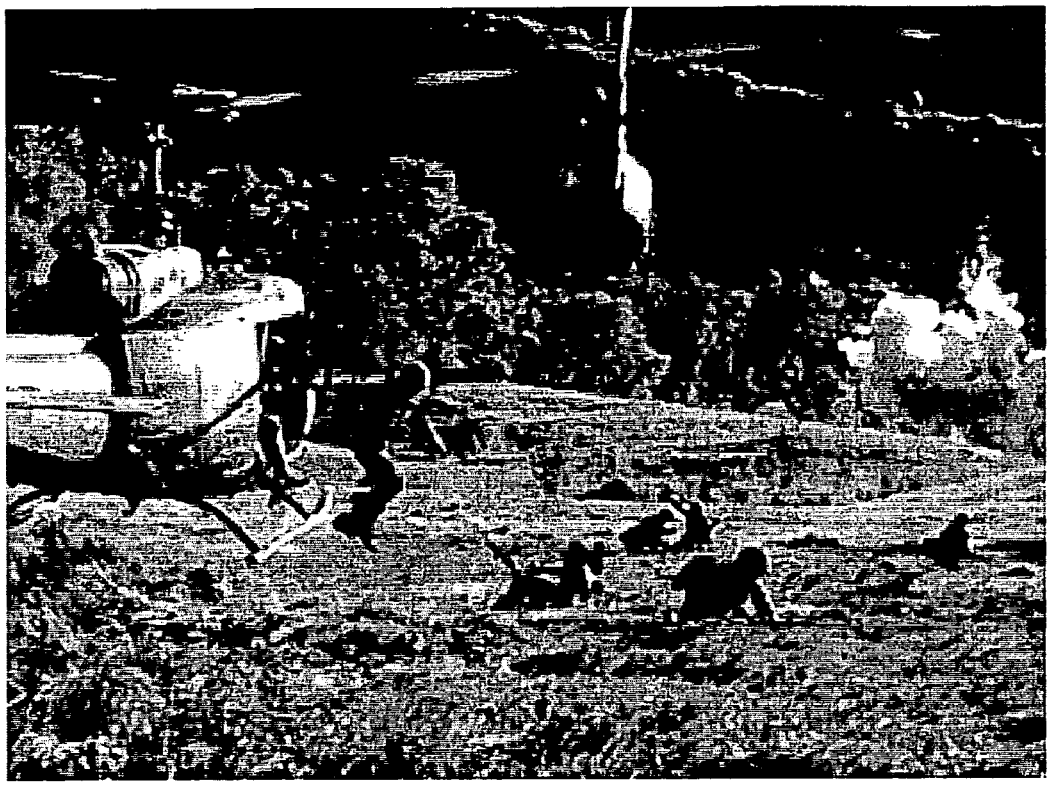
FIG. 3 RELATED ART
FIG. 3 illustrates a picture displayed by a related art liquid crystal display device.

Referring to FIG. 6, a difference in brightness levels to which white, red, green, and blue colors is increased according to the principles of the present invention. As a result, the images of the helicopter and surrounding bushes are more distinct than corresponding images in FIG. 3 of the helicopter and surrounding bushes.

As described above, the principles of the present invention provide an efficient means to improve the contrast ratio and distinctness of images displayed on a display device by adjusting a level of output data signals in accordance with an image attribute factor and an intermediate signal.

It will be appreciated that the principles of the present invention may be applied to substantially any type of display device, e.g., a non-luminous display device requiring a light source.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

an image attribute signal generating portion analyzing red (R), green (G), and blue (B) input data signals and generating a plurality of attribute signals;

a signal treating portion connected to the image attribute signal generating portion, the signal treating portion converting the R, G, and B input data signals, which have first brightness levels, to R, G, and B output data signals, which have second brightness levels lower than the first brightness levels, using the plurality of attribute signals when the R, G, and B input data signals are used to display images having colors other than white; and a display portion having a plurality of pixels, wherein each pixel includes R, G, and B sub-pixels, and wherein the R, G, and B output data signals are supplied to respective ones of the R, G, and B sub-pixels, wherein the image attribute signal generating portion includes:

a MIN-MAX extracting portion connected to the signal treating portion, the MIN-MAX extracting portion extracting minimum and maximum signals from the R, G, and B input data signals;

an image attribute factor generating portion connected to the signal treating portion, the image attribute factor generating portion analyzing R, G, and B input data signals and generating an image attribute factor ($\alpha$), wherein $0 \leqq \alpha \leqq 1$; and an intermediate signal generation portion connected to the MIN-MAX extracting portion and the signal treating portion, the intermediate signal generation portion generating an intermediate signal (W) using the minimum signal, and wherein the signal treating portion converts the R, G, and B input data signals to the R, G, and B output data signals in accordance with the expression $(Ro, Go, Bo)=((1-\alpha)\times MAX+\alpha\times W)/MAX\times(Ri, Gi, Bi)$ (where Ro, Go, and Bo are the R, G, and B output data signals, respectively, Ri, Gi, and Bi are the R, G, and B input data signals, respectively, $\alpha$ is the image attribute factor, and MAX is the maximum signal.

2. The display device according to claim 1, wherein the intermediate signal is generated in accordance with the expression $W=MIN^k$, where W is the intermediate signal, MIN is the minimum signal, and k is a real number.

3. The display device according to claim 1, further comprising:

a first signal region converting portion connected to the image attribute signal generating portion and the signal treating portion, the first signal region converting portion converting the R, G, and B input data signals in an L* signal region to the R, G, and B input data signals in a Y signal region; and a second signal region converting portion connected to the signal treating portion, the second signal region converting portion converting the R, G, and B output data signals in the Y signal region to the R, G, and B output data signals in the L* signal region.

4. The display device according to claim 3, wherein the first and second signal region converting portions each include first and second look-up tables, respectively;

the first look-up table includes pre-calculated values of the R, G, and B input data signals in the L* signal region and corresponding values of the R, G, and B input data signals in the Y signal region; and the second look-up table includes pre-calculated values of the R, G, and B output data signals in the Y signal region and corresponding values of R, G, and B output data signals in the L* signal region.

5. The display device according to claim 1, further comprising a timing controlling portion outputting the R, G, and B output data signals to the display portion.

6. The display device according to claim 1, further comprising a light source supplying light to the display portion.

7. The display device according to claim 1, wherein the display device includes a liquid crystal display device.

8. A method of driving a display device, comprising:

analyzing red (R), green (G), and blue (B) input data signals and generating a plurality of attribute signals;

converting the R, G, and B input data signals, which have first brightness levels, to R, G, and B output data signals, which have second brightness levels lower than the first brightness levels, using the plurality of attribute signals when the R, G, and B input data signals are used to display images having colors other than white; and displaying images via a plurality of pixels, wherein each pixel includes R, G, and B sub-pixels, and wherein the R, G, and B output data signals are supplied to respective ones of the R, G, and B sub-pixels, wherein analyzing the R, G, and B input data signals and generating a plurality of attribute signals includes:

extracting minimum and maximum signals from the R, G, and B input data signals;

analyzing the R, G, and B input data signals and generating an image attribute factor($\alpha$), wherein $0 \leqq \alpha \leqq 1$; and generating an intermediate signal (W) from the minimum signal, and wherein the R, G, and B input data signals are converted to the R, G, and B output data signals in accordance with the expression $(Ro, Go, Bo)=((1-\alpha)\times MAX+\alpha\times W)/MAX\times(Ri, Gi, Bi)$ (where Ro, Go, and Bo are the R, G, and B output data signals, respectively, Ri, Gi, and Bi are the R, G, and B input data signals, respectively, $\alpha$ is the image attribute factor, and MAX is the maximum signal.

9. The method of driving according to claim 8, wherein the intermediate signal is generated in accordance with the expression $W=MIN^k$, where W is the intermediate signal, MIN is the minimum signal, and k is a real number.

10. The method of driving according to claim 8, further comprising:

converting the R, G, and B input data signals from an L* signal region to R, G, and B input data signals in a Y signal region; and converting the R, G, and B output data signals from a Y signal region to R, G, and B output data signals in an L* signal region.

11. The method of driving according to claim 8, further comprising outputting the R, G, and B output data signals to respective ones of R, G, and B sub-pixels according to a timing sequence.

12. The method of driving according to claim 8, further comprising supplying light to the plurality of sub-pixels.

13. The method of driving according to claim 8, wherein the display device includes a liquid crystal display device.

* * * * *